US011890717B2

(12) United States Patent
Gurusamy et al.

(10) Patent No.: US 11,890,717 B2
(45) Date of Patent: Feb. 6, 2024

(54) POLISHING SYSTEM WITH PLATEN FOR SUBSTRATE EDGE CONTROL

(71) Applicant: Applied Materials, Inc., Santa Clara, CA (US)

(72) Inventors: Jay Gurusamy, Santa Clara, CA (US); Steven M. Zuniga, Soquel, CA (US); Jeonghoon Oh, Saratoga, CA (US)

(73) Assignee: Applied Materials, Inc., Santa Clara, CA (US)

( * ) Notice: Subject to any disclaimer, the term of this patent is extended or adjusted under 35 U.S.C. 154(b) by 718 days.

(21) Appl. No.: 16/716,213

(22) Filed: Dec. 16, 2019

(65) Prior Publication Data

US 2020/0206866 A1 Jul. 2, 2020

Related U.S. Application Data

(60) Provisional application No. 62/823,580, filed on Mar. 25, 2019, provisional application No. 62/785,156, filed on Dec. 26, 2018.

(51) Int. Cl.
*B24B 37/14* (2012.01)
*B24B 37/26* (2012.01)
(Continued)

(52) U.S. Cl.
CPC ..... *B24B 37/013* (2013.01); *B24B 37/14* (2013.01); *B24B 37/26* (2013.01); *B24B 37/27* (2013.01)

(58) Field of Classification Search
CPC ..... B24B 37/013; B24B 37/14; B24B 37/26; B24B 37/27
(Continued)

(56) References Cited

U.S. PATENT DOCUMENTS 5,899,801 A * 5/1999 Tolles ..... B24B 37/345 438/692
5,980,368 A 11/1999 Chang et al.
(Continued)

FOREIGN PATENT DOCUMENTS

EP 0747167 12/1996
WO WO 2002/078901 10/2002

OTHER PUBLICATIONS

PCT International Search Report and Written Opinion in International Application No. PCT/US2019/066597, dated Apr. 16, 2020, 12 pages.

*Primary Examiner* — Joel D Crandall
*Assistant Examiner* — Sukwoo James Chang
(74) *Attorney, Agent, or Firm* — Fish & Richardson P.C.

(57) ABSTRACT

A polishing system includes a platen having a top surface to support a main polishing pad. The platen is rotatable about an axis of rotation that passes through approximately the center of the platen. An annular flange projects radially outward from the platen to support an outer polishing pad. The annular flange has an inner edge secured to and rotatable with the platen and vertically fixed relative to the top surface of the platen. The annular flange is vertically deflectable such that an outer edge of the annular flange is vertically moveable relative to the inner edge. An actuator applies pressure to an underside of the annular flange in an angularly limited region, and a carrier head holds a substrate in contact with the polishing pad and is movable to selectively position a portion of the substrate over the outer polishing pad.

20 Claims, 6 Drawing Sheets

(51) Int. Cl.
*B24B 37/27* (2012.01)
*B24B 37/013* (2012.01)

(58) Field of Classification Search
USPC ..... 451/288
See application file for complete search history.

(56) References Cited

U.S. PATENT DOCUMENTS 6,435,949 B1 8/2002 Katsuoka et al.
6,913,518 B2 7/2005 Chen et al.
6,939,212 B1 9/2005 Pham
7,422,516 B2 * 9/2008 Butterfield ..... B23H 5/10 451/527
9,662,762 B2 5/2017 Gurusamy et al.
10,058,974 B1 * 8/2018 Chen ..... B24B 37/107
2002/0033230 A1 3/2002 Hayashi et al.
2002/0127953 A1 9/2002 Doan et al.
2003/0003850 A1 1/2003 Eaton
2003/0060134 A1 * 3/2003 Gurusamy ..... B24B 37/12 451/40
2009/0117835 A1 5/2009 Shih
2010/0120334 A1 5/2010 Crocco et al.
2011/0021115 A1 * 1/2011 Oh ..... B24B 37/04 451/10
2011/0239876 A1 10/2011 Brown
2012/0171933 A1 7/2012 Chen
2014/0273765 A1 9/2014 Chang et al.
2014/0273766 A1 9/2014 Chang et al.
2015/0065020 A1 * 3/2015 Roy ..... B24D 11/04 451/529
2017/0274495 A1 9/2017 Lau et al.
2018/0056477 A1 3/2018 Butterfield et al.
2018/0250788 A1 9/2018 Lau et al.
2020/0130131 A1 4/2020 Togawa et al.
2022/0266413 A1 8/2022 Lischka et al.

* cited by examiner

POLISHING SYSTEM WITH PLATEN FOR SUBSTRATE EDGE CONTROL

CROSS-REFERENCE TO RELATED APPLICATIONS

This application claims priority to U.S. Provisional Patent Application Ser. No. 62/823,580, filed Mar. 25, 2019, and to U.S. Provisional Patent Application Ser. No. 62/785,156, filed Dec. 26, 2018, the disclosures of which are incorporated by reference.

TECHNICAL FIELD

The present disclosure relates to monitoring during chemical mechanical polishing of substrates.

BACKGROUND

An integrated circuit is typically formed on a substrate by the sequential deposition of conductive, semiconductive, or insulative layers on a silicon wafer. One fabrication step involves depositing a filler layer over a non-planar surface and planarizing the filler layer. For certain applications, the filler layer is planarized until the top surface of a patterned layer is exposed. A conductive filler layer, for example, can be deposited on a patterned insulative layer to fill the trenches or holes in the insulative layer. After planarization, the portions of the conductive layer remaining between the raised pattern of the insulative layer form vias, plugs, and lines that provide conductive paths between thin film circuits on the substrate. For other applications, such as oxide polishing, the filler layer is planarized until a predetermined thickness is left over the non planar surface. In addition, planarization of the substrate surface is usually required for photolithography.

Chemical mechanical polishing (CMP) is one accepted method of planarization. This planarization method typically requires that the substrate be mounted on a carrier or polishing head. The exposed surface of the substrate is typically placed against a rotating polishing pad. The carrier head provides a controllable load on the substrate to push it against the polishing pad. An abrasive polishing slurry is typically supplied to the surface of the polishing pad.

One problem in CMP is determining whether the polishing process is complete, i.e., whether a substrate layer has been planarized to a desired flatness or thickness, or when a desired amount of material has been removed. Variations in the slurry distribution, the polishing pad condition, the relative speed between the polishing pad and the substrate, and the load on the substrate can cause variations in the material removal rate. These variations, as well as variations in the initial thickness of the substrate layer, cause variations in the time needed to reach the polishing endpoint. Therefore, the polishing endpoint cannot be determined merely as a function of polishing time.

In some systems, a substrate is optically monitored in-situ during polishing, e.g., through a window in the polishing pad.

SUMMARY

In one aspect, a polishing system includes a platen, an annular flange, an actuator, and a carrier head to hold a substrate. The platen has a top surface. The platen is rotatable about an axis of rotation that passes through approximately the center of the platen. The annular flange projects radially outward from the platen. The annular flange is coplanar to the polishing pad to support an outer polishing pad. The annular flange is vertically deflectable such that an outer edge of the annular flange is vertically movable relative to the inner edge. The actuator is configured to apply pressure to an underside of the annular flange in an angularly limited region. The carrier head is movable to selectively position a portion of the substrate over the outer polishing pad.

Implementations may include one or more of the following features.

The system may include the outer polishing pad. The outer polishing pad may be angularly segmented. The outer polishing pad may include a polishing surface separated from the main polishing pad by a gap. The gap may be used to drain polishing residue. The polishing surface may have a polygonal cross-section perimeter. The polishing surface may be annular.

The platen, the annular flange, or both the platen and annular flange may include a conduit for polishing residue to drain from the gap between the polishing surface of the outer polishing pad and a polishing surface of the main polishing pad. The outer polishing pad may have a conduit for polishing residue to drain.

The polishing system may include a top surface of the platen having an aperture, a second annular flange, and a second actuator. The aperture may be location in approximately the center of the platen. The second annular flange may project radially inwardly from the platen into the aperture to support a second polishing pad segment.

The second annular flange is coplanar to the polishing pad. The second annular flange has an outer edge secured to and rotatable with the platen. The second annular flange is vertically fixed relative to the stop surface of the platen. The second annular flange is vertically deflectable such that an inner edge of the second annular flange is vertically moveable relative to the outer edge. The second actuator is configured to apply pressure to an underside of the second annular flange in an angularly limited region. The second actuator may be supported by the platen and may be rotationally decoupled from the platen by a bearing.

The aperture may comprise a recess extending partially but not entirely through the platen. The aperture may comprise a conduit through the platen for liquid polishing residue to drain from the recess.

The polishing system may include a carrier head that is movable to selectively position a portion of the substrate over the second polishing pad segment.

The polishing system may include the main polishing pad. The outer polishing pad may be harder than the main polishing pad. The outer polishing pad may be softer than the main polishing pad. The outer polishing pad and the main polishing pad may be composed of the same material.

Implementations may optionally include, but are not limited to, one or more of the following advantages. Polishing non-uniformity, e.g., caused by a polishing head profile issue at a substrate edge, can be corrected. Additionally, there is a minimal impact to throughput because edge-correction can be performed in the polishing station rather than as part of a separate module. This permits a higher rate of substrates polished per unit of time since the profile edge-correction may be made without having to move the substrate to a separate station. No additional motor is necessary since the platen motor is used to also rotate the annular flange. Another advantage to performing the polishing and the edge-correction in the same polishing station is that a second station is not necessary to perform the edge-correction, reducing the footprint needed in the polishing station clean room. Furthermore, pressure may applied to an underside of the annular flange in an angularly limited region, permitting control of the region in which the polishing correction occurs. Moreover, the applied pressure can be increased to allow for a higher rate of corrective polishing or decreased to allow for a lower rate of corrective polishing. The annular flange can be harder, softer, and of a different material than the polishing pad, and thus can allow for a different rate of polishing than the polishing pad. Furthermore, portions of the segmented pad that are not under the substrate may be conditioned cleaned as they spin about the platen axis.

The details of one or more implementations are set forth in the accompanying drawings and the description below. Other aspects, features, and advantages will be apparent from the description and drawings, and from the claims.

BRIEF DESCRIPTION OF THE DRAWINGS

Like reference numbers and designations in the various drawings indicate like elements.

DETAILED DESCRIPTION

In some chemical mechanical polishing operations, a portion of a substrate can be under polished or over polished. In particular, the substrate tends to be over-polished or under-polished at or near the substrate edge, e.g., a band located 0 to 10 mm from the substrate edge. One technique to address such polishing non-uniformity is to transfer the substrate to a separate "touch up" tool, e.g., to perform edge-correction. However, the additional tool consumes valuable footprint within the clean room, and can have an adverse effect on throughput. However, these problems can be addressed by positioning a portion of the substrate over an annular ring that is secured to the platen and that is pushed upwardly against the substrate by an actuator that deforms the annular ring.

Figure 1:
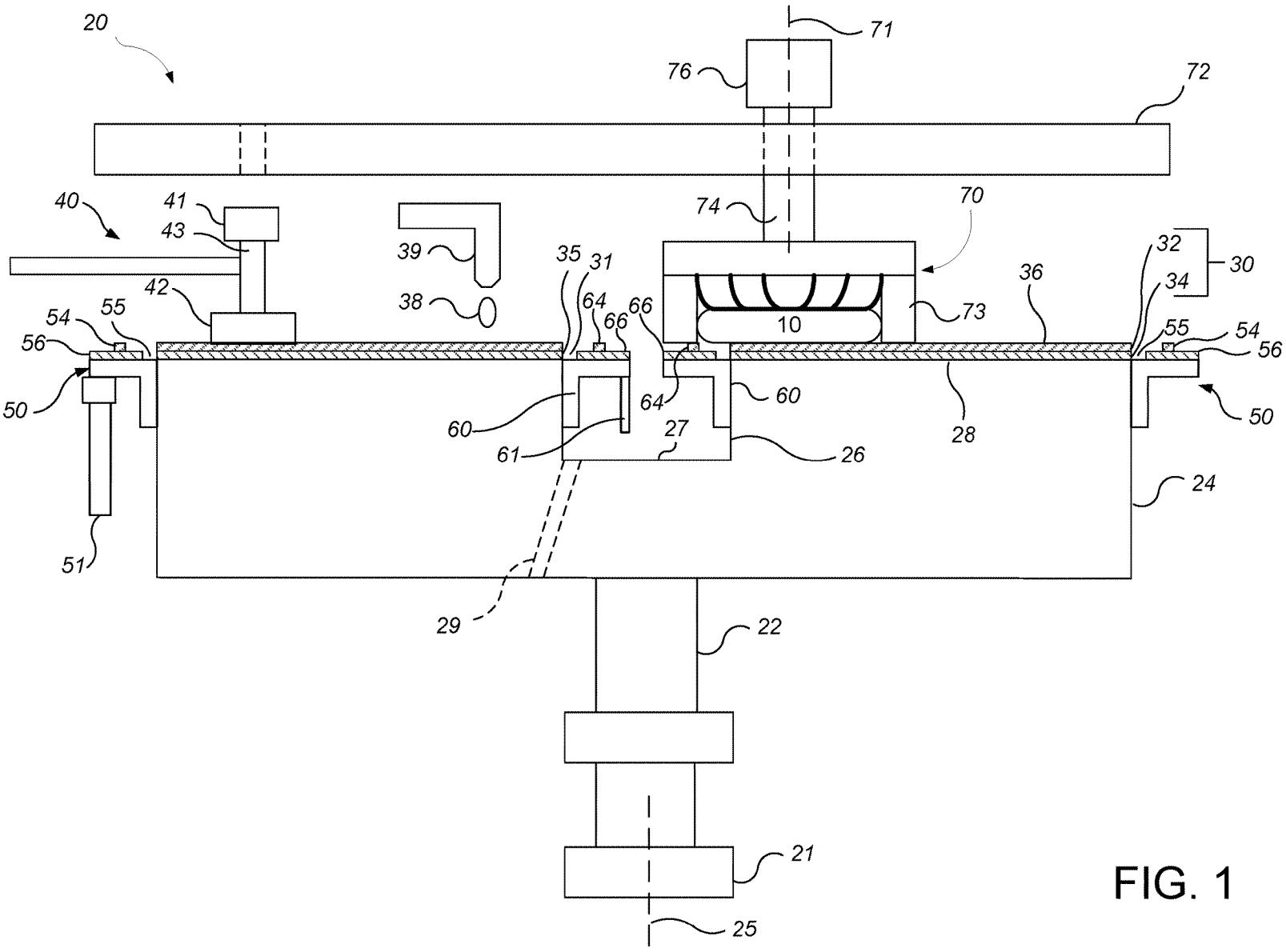
FIG. 1 shows a schematic cross-sectional view of a chemical mechanical polishing system.
Figure 2:
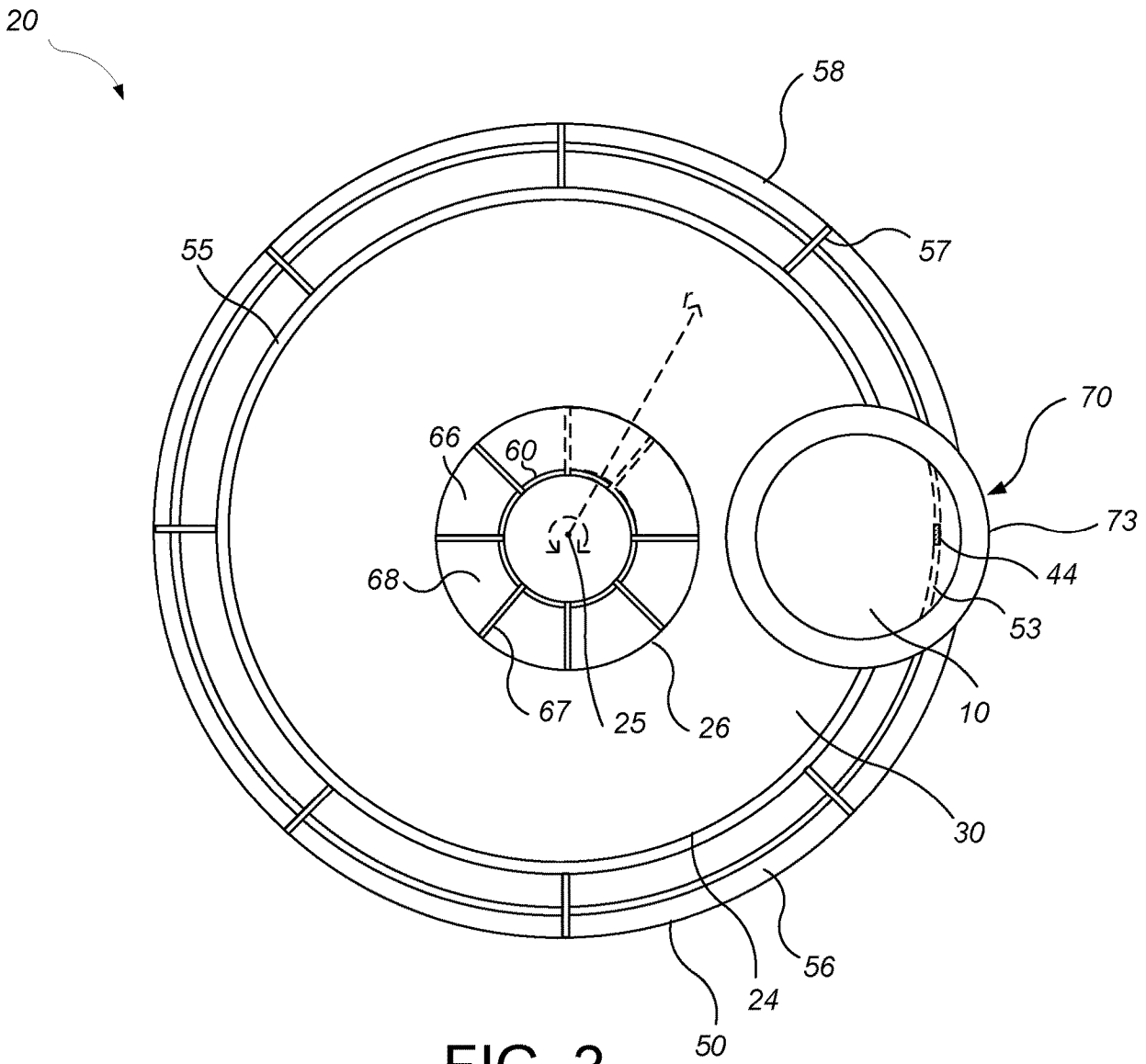
FIG. 2 shows a schematic top view of the chemical mechanical polishing system of claim 1.

FIGS. 1 and 2 show a polishing system 20 operable to polish a substrate 10. The polishing system 20 includes a rotatable platen 24, on which a main polishing pad 30 is situated.

The platen is operable to rotate about an axis 25. For example, a motor 21 can turn a drive shaft 22 to rotate the platen 24. In some implementations, the platen 24 is configured to provide an annular upper surface 28 to support the main polishing pad 30. In some implementations, an aperture 26 is formed in the upper surface 28 at the center of the platen 24. A center of the aperture 26 can be aligned with the axis of rotation 25. For example, the aperture 26 can be circular and the center of the aperture 26 can be co-axial with the axis of rotation 25. Where the platen 24 has an annular upper surface, a hole 31 can be formed through the main polishing pad 30 to provide the polishing pad with an annular shape.

In some implementations, the aperture 26 is a recess that extends partially but not entirely through the platen 24. In some implementations, the aperture 26 provides entirely through the platen 24 (see FIG. 3), e.g., the aperture 26 provides a passage through the platen 24.

The diameter of the aperture 26 (e.g., the portion adjacent the surface 28, either as a recess or as an upper portion of the passage through the platen 24) can be about 5% to 40% of the diameter of the platen 24, e.g., about 5% to 15%, or 20% to 30%. For example, the diameter can be 3 to 12 inches in a 30 to 42 inch diameter platen.

However, the aperture 26 in the platen 24 and hole 31 in the polishing pad 30 are optional; both the polishing pad 30 and platen 24 can be solid circular bodies with solid circular upper surfaces.

The main polishing pad 30 can be secured to the upper surface 28 of the platen 24, for example, by a layer of adhesive. When worn, the main polishing pad 30 can be detached and replaced. The main polishing pad 30 can be a two-layer polishing pad with an outer polishing layer 32 having a polishing surface 36, and a softer backing layer 34. If the main polishing pad 30 is annular, then the main polishing pad 30 has an inside edge 35 which defines the perimeter of the hole 31 through the pad 30. The inner edge 35 of the pad 30 can be circular.

The polishing system 20 can include a polishing liquid delivery arm 39 and/or a pad cleaning system such as a rinse fluid delivery arm. During polishing, the arm 39 is operable to dispense a polishing liquid 38, e.g., slurry with abrasive particles. In some implementations, the polishing system 20 include a combined slurry/rinse arm. Alternatively, the polishing system can include a port in the platen operable to dispense the polishing liquid onto the main polishing pad 30.

The polishing system 20 includes a carrier head 70 operable to hold the substrate 10 against the main polishing pad 30. The carrier head 70 is suspended from a support structure 72, for example, a carousel or track, and is connected by a carrier drive shaft 74 to a carrier head rotation motor 76 so that the carrier head can rotate about an axis 71. In addition, the carrier head 70 can oscillate laterally across the polishing pad, e.g., by moving in a radial slot in the carousel as driven by an actuator, by rotation of the carousel as driven by a motor, or movement back and forth along the track as driven by an actuator. In operation, the platen 24 is rotated about its central axis 25, and the carrier head is rotated about its central axis 71 and translated laterally across the top surface of the polishing pad.

The polishing system 20 can also include a conditioner system 40 with a rotatable conditioner head 42, which can include an abrasive lower surface, e.g. on a removable conditioning disk, to condition the polishing surface 36 of the main polishing pad 30. The conditioner system 40 can also include a motor 41 to drive the conditioner head 42, and a drive shaft 43 connecting the motor 41 to the conditioner head 42. The conditioner system 40 can also include an actuator configured to sweep the conditioner head 40 laterally across the main polishing pad 30, the outer polishing pad 56, and an optional inner polishing pad 66.

The polishing system 20 also includes at least one annular flange that is secured to and rotates with the platen. A portion of an inner or outer polishing pad is placed on the flange, and the flange is deformable by an actuator such that an angularly limited section of the inner or outer polishing pad is biased against the bottom surface of the substrate. The annular flange can project outwardly from an outer edge of the platen, project inwardly from an inner edge of an annular platen, or there can be two flanges, one for each position.

As shown in the example of FIGS. 1 and 2, the polishing system 20 includes an annular flange 50 that projects radially outward from the platen 24. If not deflected or deformed, a top surface of the annular flange 50 is substantially coplanar with the upper surface 28 of the platen 24. An inner edge of the annular flange 50 is secured to and rotatable with the platen 24. Therefore the annular flange 50 can rotate with the platen 24 when the drive shaft 22 rotates the platen 24 (so the annular flange 50 does not require a separate motor for rotation).

The inner edge of the annular flange 50 is vertically fixed relative to the top surface of the platen 24. However, the annular flange 50 is vertically deflectable such that an outer edge of the annular flange 50 is vertically movable relative to the inner edge of the annular flange 50. In particular, the polishing system 20 includes an actuator 51 to apply pressure to an underside of the annular flange 50 in an angularly limited region 44, thus deforming a segment of the outer polishing pad 56.

Figure 5A:
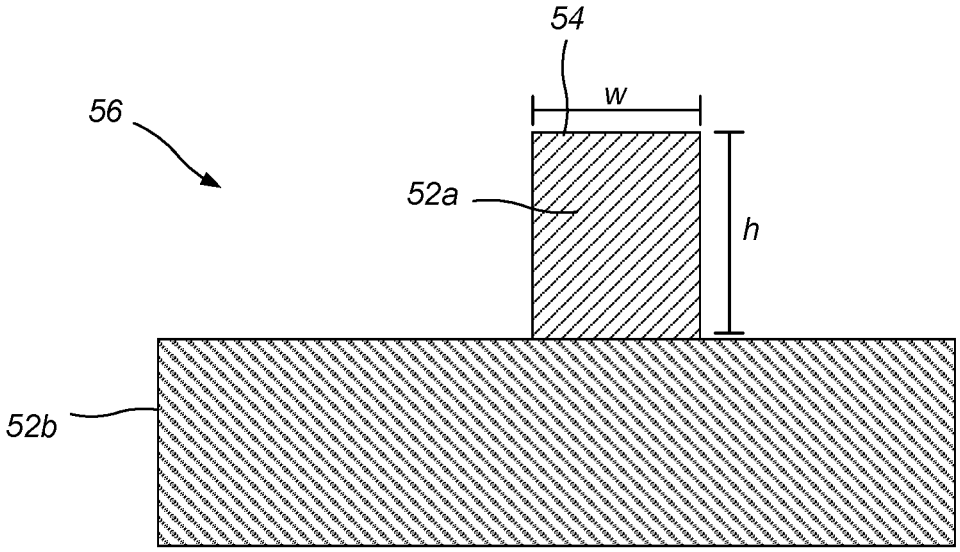
FIGS. 5A and 5B show a schematic cross-sectional view of outer and inner polishing pads, respectively.

The polishing system 20 can include an outer polishing pad 56 that is supported by and secured to the annular flange 50. The outer polishing pad 56 can be used to perform corrective polishing on the substrate, e.g., on a portion of the substrate 10 at or near the edge of a substrate 10. The outer polishing pad 56 can have a similar layer structure as the main polishing pad 30, e.g., a polishing layer 52*a* supported on a backing layer 52*b* (see FIG. 5A).

The outer polishing pad 56 can be angularly segmented. Referring to FIG. 2, the otherwise annular outer polishing pad 56 can be broken into angular pad segments 58 by channels 57. The channels 57 can be spaced at equal angular intervals around the axis of rotation of the platen, and the segments 58 can have equal arc lengths. Although FIG. 2 illustrates eight channels 57 that divide the outer polishing pad into eight segments 58, there could be a larger or small number of channels 57 and segments 58. The channels 57 can also be used to drain the polishing by-product, e.g., slurry 38 or debris from the polishing process. The pad segments 58 that are not below the substrate 10 can be conditioned by the conditioning system 40 as they spin about the axis of rotation 25 of the platen 24.

The polishing surface of the outer polishing pad 56 can be separated from the main polishing pad 30 by a gap 55. The channels 57 can extend to the gap 55 so that polishing residue (e.g., polishing slurry 38 or debris from the polishing process) can drain from the channels 57 into the gap 55. One or more conduits 59 with openings within the gap 55 can enable the polishing residue to drain from the gap 55 (see FIG. 6).

The outer polishing surface 54 of the outer polishing pad 56 can be annular, and can be concentric with the axis of rotation 25 of the platen. In some implementations, the outer polishing pad 56 includes an annular projection 52*a* that extends upwardly from a lower layer 52*b* (see FIG. 5A). The channels 57 can divide the annular projection 52*a* into a plurality of arcs 53. A top surface of the annular projection 52*a* provides the outer polishing surface 54. Each arc 53 can have a width w (measured along a radius of the platen). The width w can be uniform angularly along the arc 53. Each arc can have the same dimension, or the widths w can vary from one arc 53 to another. The width w is sufficiently small to permit the outer polishing pad 56 to perform corrective polishing on a narrow portion of the substrate 10, e.g., a region 1 to 30 mm wide, e.g., 1 to 10 mm wide, e.g., 5 to 30 mm wide (e.g., on a 300 mm diameter circular substrate).

The annular projection 52*a* can have a rectangular cross section (perpendicular to the top surface of the flange or to the polishing surface 36). The side walls of the annular projection can be vertical, so that as the annular projection wears down, the area affected on the substrate 10 by the annular projection remains the same. The radial position of the projection and width of the projection can be selected based on empirically measured non-uniformity measurements for a particular polishing process.

However, many other configurations are possible for the outer polishing surface 54. For example, the outer polishing surface 54 could be provided by cylindrical projections spaced angularly, e.g., evenly spaced, around the axis of rotation.

Figure 4:
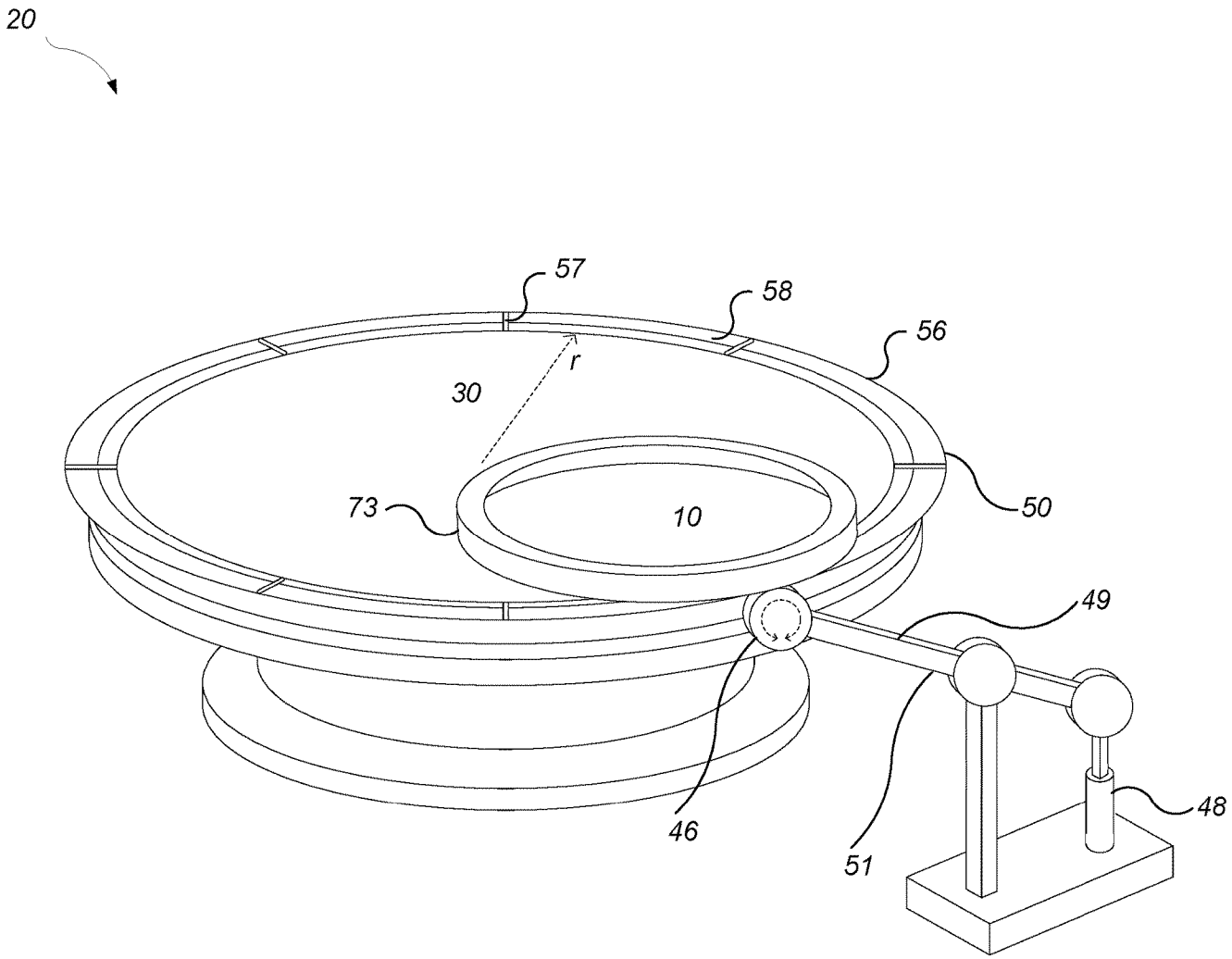
FIG. 4 shows a perspective view of a chemical mechanical polishing system.

The actuator 51 can be a mechanical and/or electrical apparatus (see FIG. 4). The actuator 51 can be, for example, an air cylinder 48 mounted to a pivoting arm 49 that can swing upwardly to deform the annular flange 50. The end of the actuator 51 that is in contact with the annular flange 50 can be a wheel 46 that is in static contact with the annular flange 50. The wheel 46 is free to rotate; it need not be driven by a motor. This permits the actuator 51 to apply a vertical force to the annular flange 50 without applying substantial horizontal force (e.g., friction) to the annular flange 50 as it rotates.

The actuator 51 can apply an upward force to an angularly limited region 44 of the flange 50, e.g., less than all of the radial arc 53 of the projection 52*a* spanned by the substrate 10. In particular, the actuator 51 can apply upward force to a region 44 that is about 0.5-4 mm wide and 20-50 mm long. The upward pressure from the actuator 51 causes the flange 50 to locally distort, so that an angularly limited portion of the projection 52*a* corresponding to the angularly limited region 44 moves into the contact with the substrate 10.

The carrier head 70 is movable to selectively position a portion of the substrate 10 over the outer polishing pad 56. In particular, the carrier head 70 can position a first portion of the substrate 10 over the main polishing pad 30 and a second portion of the substrate over the outer polishing pad 56. By selection of the position of the carrier head 70 (and thus substrate 10) in view of the shape and location of the outer polishing surface 54, and by control of the degree of deformation of the flange 50 by the actuator 51, the polishing system 10 can establish a differential in polishing rates in different annular zones on the substrate. This effect can be used to provide correction, e.g., edge-correction, of the substrate 10.

The carrier head 70 can rotate to provide angularly symmetric correction of the edge. However, in some implementations, the carrier head 70 does not rotate during the corrective polishing by the outer polishing pad 56. This permits the corrective polishing to be performed in an angularly asymmetric manner.

Having the same carrier head 70 for the main polishing pad 30 and the outer polishing pad 56 permits the polishing "touch up" to be performed at the same station as the main polishing operation. There is limited impact to throughput since edge-correction is not part of a separate module. Additionally, the advantage of not requiring a separate module means less footprint is needed in the polishing station for the polishing process within the clean room for the system 20 to perform the polishing of the substrate 10.

In some implementations, the polishing system 20 can have an aperture 26 that is provided by a recess that extends partially but not entirely through the platen 24 (see FIG. 1).

Figure 3:
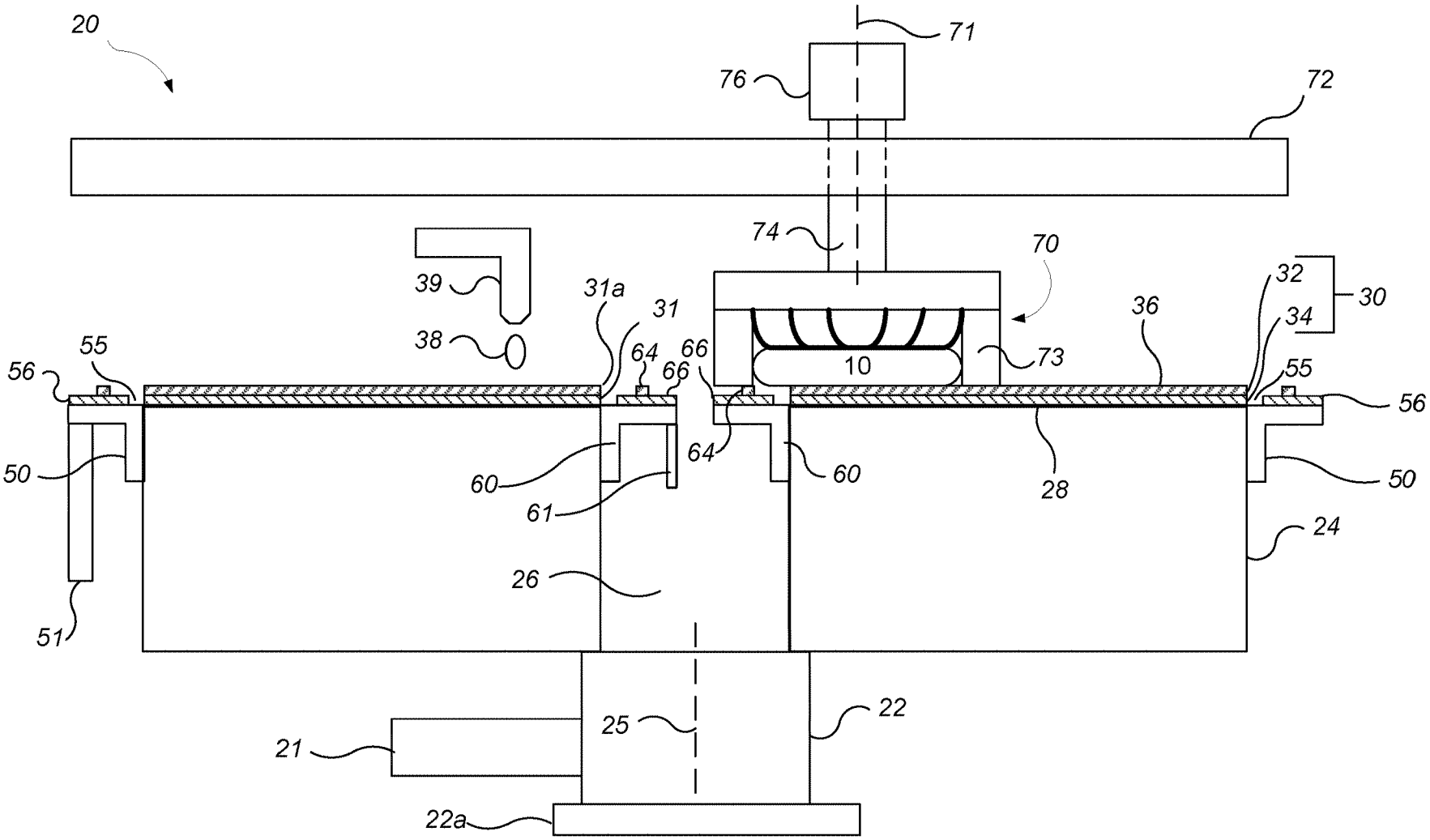
FIG. 3 shows a schematic cross-sectional view of a chemical mechanical polishing system in which an aperture passes entirely through the platen.

Alternatively, the platen 24 can have an aperture 26 that extends entirely through the platen 24 (see FIG. 3). In this case, the platen 24 is itself an annular body. For this configuration, the drive shaft 22 can be a cylindrical body, and can be supported on or be provided by a ring bearing 22*a*, which in turn is supported on the frame of the polishing system 20. In some implementations, the drive motor 21 can be coupled to the outside of the drive shaft 22 above the ring bearing 22*a*. The aperture 26 can provide draining for polishing residue (e.g., polishing liquid 38 or debris from the polishing process). A conduit 29 can drain the polishing residue from a recess that does not extend through the platen 24.

The polishing system 20 can have a second annular flange 60 that projects radially inward from the platen 24 into the aperture 26. If not deflected or deformed, a top surface of the second annular flange 60 is coplanar with the upper surface 38 of the platen 24. The second annular flange 60 has an outer edge that is secured to and rotatable with the platen 24, and the outer edge of the second annular flange 60 is fixed relative to the top surface of the platen 24. The second annular flange 60 can be vertically deflectable such that an inner edge of the second annular flange 60 is vertically movable relative to the outer edge when a second actuator 61 applies pressure to an underside of the second annular flange 60 in an angularly limited region 44. The second actuator 61 can be, for example, an air cylinder 48 mounted to a pivoting arm 49 that deforms the second annular flange 60.

The carrier head 70 can be movable to selectively position a portion of the substrate 10 over the main polishing pad 30 and the inner polishing pad 66. Where the platen 24 includes the aperture 26, the carrier head 70 can be laterally positioned such that the substrate 10 partially overhangs the hole 31 in the main polishing pad 30 during polishing. Due to the hole 31, the center region of the main polishing pad 30 is not used, which can improve uniformity and reduce defects. For example, the polishing rate near the center of the main pad 30 can have a decreased polishing rate as compared to a more outer portion of the main pad 30, as velocity of the pad increases proportionally as a function of radial distance r from the axis of rotation 25 (see FIG. 2). Therefore, a portion of the main pad 30 with a smaller value of r will have a lower velocity and will have a decreased polishing rate. There is also limited impact to throughput since edge-correction is not part of a separate module. Additionally, the benefit of not requiring a separate module means less footprint is needed in the polishing station for the polishing process within the clean room for the system 20 to perform the polishing of the substrate 10.

The polishing system 20 can include an inner polishing pad 66 that is supported by and secured to the second annular flange 60. The inner polishing pad 66 can be angularly segmented. The angular segmentation of the inner polishing pad 66 can be done by channels 67. Channels 67 can also be used to drain the polishing by-product, e.g., slurry or debris from polishing.

Figure 5B:
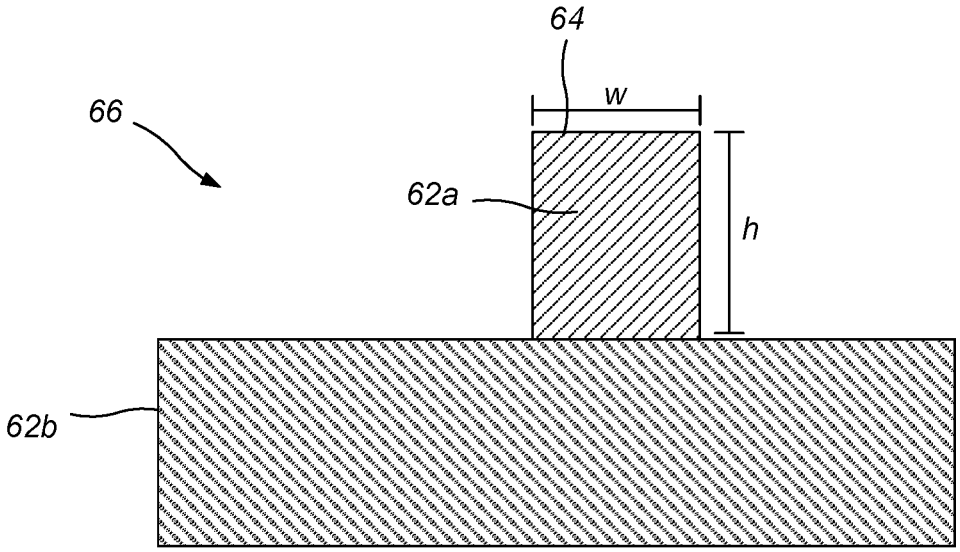

The polishing surface 64 of the inner polishing pad 66 can be annular. In some implementations, the inner polishing pad 66 includes an annular projection 62*a* that extends upwardly from a lower layer 62*b* (see FIG. 5B). The channels 67 can divide the annular projection 62*a* into a plurality of arcs. A top surface of the annular projection 62*a* provides the inner polishing surface 64. The annular projection has a width w. The width w can be uniform angularly around the platen. The annular projection can have a rectangular cross section (perpendicular to the top surface of the flange or to the polishing surface 36).

Since only one segmented pad may be positioned under the substrate 10 at a time, the inner and/or outer pads that are not below the carrier head 70 can be conditioned by the conditioning system 40 as they spin about the platen 24 axis of rotation 25.

The polishing surface of the inner polishing pad 66 can be annular to be supported by and secured to the top of the second annular flange 60. The carrier head 70 can hold the substrate 10 in contact with the main polishing pad 30 and is movable to selectively position a portion of the substrate 10 over the main polishing pad 30 and the inner polishing pad 66 to provide correction, e.g., edge-correction, of the substrate 10.

The polishing system 20 can have the outer polishing pad 56 be harder than the main polishing pad 30, or softer than the main polishing pad 30. The outer polishing pad 56 can be composed of the same material as the main polishing pad 30, or composed of a different material than the main polishing pad 30.

The polishing system 20 can have the inner polishing pad 66 be harder than the main polishing pad 30, or softer than the main polishing pad 30. The inner polishing pad 66 can be composed of the same material as the main polishing pad 30, or composed of a different materials than the main polishing pad 30.

The polishing system 20 can have the outer polishing pad 56 be harder than the inner polishing pad 66, or softer than the inner polishing pad 66. The outer polishing pad 56 can be composed of the same material as the inner polishing pad 66, or composed of a different material than the inner polishing pad 66.

Figure 6:
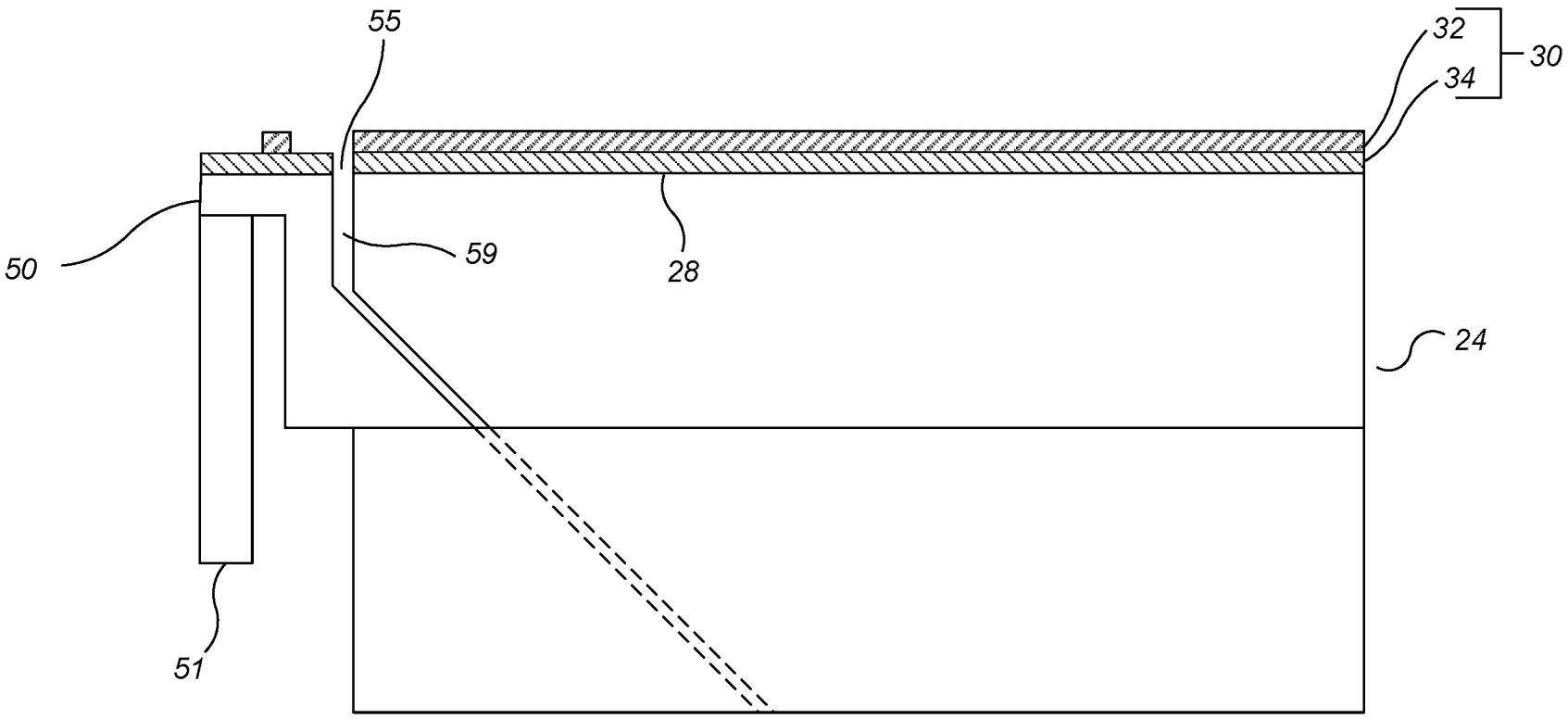
FIG. 6 shows a schematic cross-sectional view of a chemical mechanical polishing system with a conduit.

Referring to FIG. 6, the platen 24 and/or annular flange 50 can have a conduit 59 to drain polishing by-product, e.g., slurry 38 or debris from polishing, through a gap 55 between the polishing surface of the outer polishing pad 56 and the polishing surface of the main polishing pad 30.

As used in the instant specification, the term substrate can include, for example, a product substrate (e.g., which includes multiple memory or processor dies), a test substrate, a bare substrate, and a gating substrate. The substrate can be at various stages of integrated circuit fabrication, e.g., the substrate can be a bare wafer, or it can include one or more deposited and/or patterned layers. The term substrate can include circular disks and rectangular sheets.

The above described polishing system and methods can be applied in a variety of polishing systems. Either the polishing pad, or the carrier head, or both can move to provide relative motion between the polishing surface and the substrate. The polishing pad can be a circular (or some other shape) pad secured to the platen. The polishing layer can be a standard (for example, polyurethane with or without fillers) polishing material, a soft material, or a fixed-abrasive material. Terms of relative positioning are used; it should be understood that the polishing surface and substrate can be held in a vertical orientation or some other orientation.

Particular embodiments of the invention have been described. Other embodiments are within the scope of the following claims. For example, the actions recited in the claims can be performed in a different order and still achieve desirable results.

What is claimed is:

1. A polishing system, comprising:

a platen having a top surface to support a main polishing pad, the platen rotatable about an axis of rotation that passes through approximately a center of the platen;

an annular flange projecting radially outward from the platen to support an outer polishing pad, the annular flange being a unitary body having an inner edge secured to and rotatable with the platen and vertically fixed relative to the top surface of the platen, the annular flange being deformable and vertically deflectable such that an outer edge of the annular flange is vertically movable relative to the inner edge;

an actuator configured to apply pressure to an underside of the annular flange in an angularly limited region such that the angularly limited region of the annular flange and an angularly limited portion of the outer polishing pad are lifted relative to the platen, an undeformed portion of annular flange, and main polishing pad; and a carrier head to hold a substrate in contact with the main polishing pad and movable to selectively position a portion of the substrate over the angularly limited portion of the outer polishing pad.

2. The polishing system of claim 1, comprising the outer polishing pad.

3. The polishing system of claim 2, wherein the outer polishing pad is angularly segmented by channels.

4. The polishing system of claim 2, wherein the outer polishing pad has a polishing surface separated from the main polishing pad by a gap.

5. The polishing system of claim 4, wherein the polishing surface has a polygonal cross-section perimeter.

6. The polishing system of claim 4, wherein the polishing surface is annular.

7. The polishing system of claim 2, wherein the outer polishing pad has a conduit for polishing residue to drain.

8. The polishing system of claim 2, further comprising the main polishing pad.

9. The polishing system of claim 8, wherein the outer polishing pad is harder than the main polishing pad.

10. The polishing system of claim 8, wherein the outer polishing pad is softer than the main polishing pad.

11. The polishing system of claim 8, wherein the main polishing pad and outer polishing pad are composed of the same material.

12. The polishing system of claim 1, wherein the platen, or the annular flange, or both, comprise a conduit for polishing residue to drain from a gap between a polishing surface of the outer polishing pad and a polishing surface of the main polishing pad.

13. The polishing system of claim 1, further comprising:

an aperture in the top surface of the platen that overlaps the center of the platen;

a second annular flange projecting radially inward from the platen into the aperture to support an inner polishing pad, the second annular flange having an outer edge secured to and rotatable with the platen and vertically fixed relative to the top surface of the platen, the second annular flange being vertically deflectable such that an inner edge of the second annular flange is vertically movable relative to the outer edge; and a second actuator configured to apply pressure to an underside of the second annular flange in an angularly limited region such that an angularly limited section of the second annular flange and an angularly limited portion of the inner polishing pad are lifted relative to the platen, an undeformed portion of the annular flange, and main polishing pad.

14. The polishing system of claim 13, wherein the aperture comprises a recess extending partially but not entirely through the platen.

15. The polishing system of claim 14, comprising a conduit through the platen for liquid polishing residue to drain from the recess.

16. The polishing system of claim 13, wherein the carrier head is movable to selectively position a portion of the substrate over the inner polishing pad.

17. The polishing system of claim 1, wherein an upper surface of the annular flange is coplanar to a top surface of the platen.

18. The polishing system of claim 1, wherein the actuator includes an arm having a wheel in contact with the underside of the annular flange.

19. The polishing system of claim 18, wherein the wheel is in static contact with the underside of the annular flange.

20. A polishing system, comprising:

an annular platen having a top surface to support a main polishing pad, the annular platen having an aperture in a top surface of the annular platen that overlaps a center of the annular platen, the annular platen rotatable about an axis of rotation that passes through approximately the center of the annular platen;

an annular flange projecting radially inward from the annular platen into the aperture to support an inner polishing pad, the annular flange being a unitary body having an outer edge secured to and rotatable with the annular platen and vertically fixed relative to the top surface of the annular platen, the annular flange being vertically deflectable such that an inner edge of the annular flange being deformable and vertically movable relative to the outer edge of the annular flange;

an actuator configured to apply pressure to an underside of the annular flange in an angularly limited region such that the angularly limited region of the annular flange and an angularly limited portion of the inner polishing pad are lifted relative to the annular platen, an undeformed portion of the annular flange, and main polishing pad; and a carrier head to hold a substrate in contact with the main polishing pad and movable to selectively position a portion of the substrate over the angularly limited portion of the inner polishing pad.

* * * * *